US005974778A

United States Patent [19]

Stahlecker

[11] Patent Number: 5,974,778

[45] Date of Patent: Nov. 2, 1999

[54] ARRANGEMENT FOR OPEN-END SPINNING COMPRISING A DRIVEN SUCTION ROLLER

[75] Inventor: Fritz Stahlecker, Josef-Neidhart-Strasse 18, 73337 Bad Überkingen, Germany

[73] Assignees: Hans Stahlecker, Suessen; Fritz Stahlecker, Ueberkingen, both of Germany

[21] Appl. No.: 08/910,134

[22] Filed: Sep. 13, 1997

[30] Foreign Application Priority Data

Aug. 27, 1996 [DE] Germany ..... 196 34 538

[51] Int. Cl.[6] ..... D01H 4/00

[52] U.S. Cl. ..... 57/401; 57/403; 57/411

[58] Field of Search ..... 57/400, 401, 408, 57/409, 411, 13, 403, 332, 335, 328, 404, 350

[56] References Cited

U.S. PATENT DOCUMENTS 5,241,813 9/1993 Rottmayr et al. ..... 57/401

5,778,653 7/1998 Stahlecker ..... 57/401

FOREIGN PATENT DOCUMENTS 331 66 58A1 1/1985 Germany .

*Primary Examiner*—William Stryjewski

*Attorney, Agent, or Firm*—Evenson McKeown Edwards & Lenahan, PLLC

[57] ABSTRACT

In the case of an arrangement for open-end spinning, a driven suction roller is provided which in a take-up zone takes up fiber material opened to single fibers and transports it to a suctioned yarn formation line. The yarn formation line is defined by a suction insert arranged in the inside of the suction roller, and extends transversely to the transport direction of the suction roller on the surface thereof. In extension of the yarn formation line a twist device is provided. On the side facing away from the twist device, the suction roller is supported on the suction insert while freely overhanging same, so that the twist device reaches directly up to the suctioned yarn formation line. The yarn formation line is preferably inclined at an angle towards the take-up zone on the side facing away from the twist device.

24 Claims, 3 Drawing Sheets

A
B

ARRANGEMENT FOR OPEN-END SPINNING COMPRISING A DRIVEN SUCTION ROLLER

This application claims the priority of German application 196 34 538.3 filed in Germany on Aug. 27, 1996, the disclosure of which is expressly incorporated by reference herein.

BACKGROUND AND SUMMARY OF THE INVENTION

The present invention relates to an arrangement for open-end spinning comprising a driven suction roller for taking up fiber material which has been opened to single fibers and for transporting the fiber material from a take-up zone to a suctioned yarn formation line, which is defined by a suction insert arranged in the inside of the suction roller and which extends on the surface of the suction roller transversely to the transport direction thereof, whereby a twist device is provided in extension of the yarn formation line in close proximity to the suction roller.

In the case of an arrangement of this type (U.S. Pat. No. 5,241,813), the functions of collecting the single fibers, binding the single fibers into the forming yarn and imparting a twist to the yarn are all separate from one another. As the yarn, as long as it is disposed at the yarn formation line on the surface of the suction roller, obtains only a relatively slight pre-twist at first, there is a risk that the continually new forming yarn tips will hang down from the continuously withdrawn yarn or at least that from time to time thin spots form in the yarn. This is in particular the case when, in order to avoid crimping of the single fibers at the yarn formation line, the yarn is withdrawn at a speed which is higher than the arrival speed of the single fibers at the yarn formation line. In this case of the prior art, the dwell time of the continually renewing yarn tip in the yarn formation line is extremely short, so that a sufficiently intensive and timely twist is not guaranteed. Even if the twist device is arranged relatively near to the suction roller, there still exists a certain unguided section of the collected fibers between the suction roller and the twist device.

It is an object of the present invention, in the case of an arrangement of the above mentioned type to improve twist impartation in the forming yarn, in particular at high yarn withdrawal speeds.

The object of the present invention is achieved by the invention in that the suction roller, on the side facing away from the twist device, is supported on the suction insert while freely overhanging same, and the suctioned yarn formation line reaches in direct proximity to the twist device.

By means of the constructive embodiment of the bearing of the suction roller, there are no bearing elements between the twist device and the suction roller, so that there is almost no unguided section of the fiber accumulation between the twist device and the suction roller. The twist device can thus be brought to the point at which the fiber accumulation ends at the yarn formation line. The last single fibers fed to the yarn formation line reach an almost finished yarn when the twist device adjoins the collecting area with no space in between.

Free overhanging suction rollers are known from German published patent application 33 16 658, but not in connection with a twist device arranged downstream. The purpose of the known free overhanging bearing is rather more that one end of the sleeve of the suction roller is left free, so that cleaning of the interior of the sleeve from this side is possible.

The twist device can be guided particularly near to the yarn formation line when it takes the form of a spinning jet, as is known in principle from pneumatic false twist spinning. The single fibers reach the yarn formation line directly upstream of the entry opening of the yarn in the spinning jet. This jet determines the final extent of the twist.

In an advantageous embodiment of the invention it is provided that the yarn formation line is bent towards the take-up zone on the side facing away from the twist device. The continuously renewing yarn tip obtains a certain thrust in transport direction therefrom, which lessens the longitudinal tension in the area of the yarn tip. The risk of yarn tips hanging from the withdrawn yarn and the risk of thin spots are thus reduced. By altering the angle of the bend, the transport thrust on the yarn and the longitudinal tension of the withdrawn yarn can be altered as required.

The yarn formation line can be guided to within the area of the take-up zone and can extend at least approximately in transport direction of the suction roller. Thus the transport thrust is at its strongest in the area of the outermost yarn tip at a practically negligibly low tension. The more the yarn is bent in the direction towards the yarn formation line, the weaker the transport thrust becomes, while the longitudinal tension in contrast becomes stronger. The longitudinal tension is at its highest after receiving the last single fibers, directly upstream of the twist device. It is hereby favorable when the yarn tip transfers to the actual yarn formation line over a rounded transition point.

In order to increase the pre-twist to the yarn, a supplementary roller driven in the same direction as the suction roller can be arranged thereto, which supplementary roller forms a wedge-shaped gap together with the suction roller, at least in the area of the yarn formation line arranged at the twist device. As the transport speed of the suction roller should be lower than the withdrawal speed of the yarn and is thus limited in its range, the supplementary roller, in particular when it is subject to slip, can be driven at an increased speed. The supplementary roller may also take the form of a nipping roller. The pre-twist is then more secure, with less slip, and the yarn obtains in its formation phase a degree of tensile strength.

For the purpose of the present invention it is advantageous when the suction effect of the suction insert is stronger in the area of the yarn formation line than in the remaining areas. The yarn formation line is thereby exactly defined, in particular when the fiber tip is bent in the direction towards the take-up zone.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
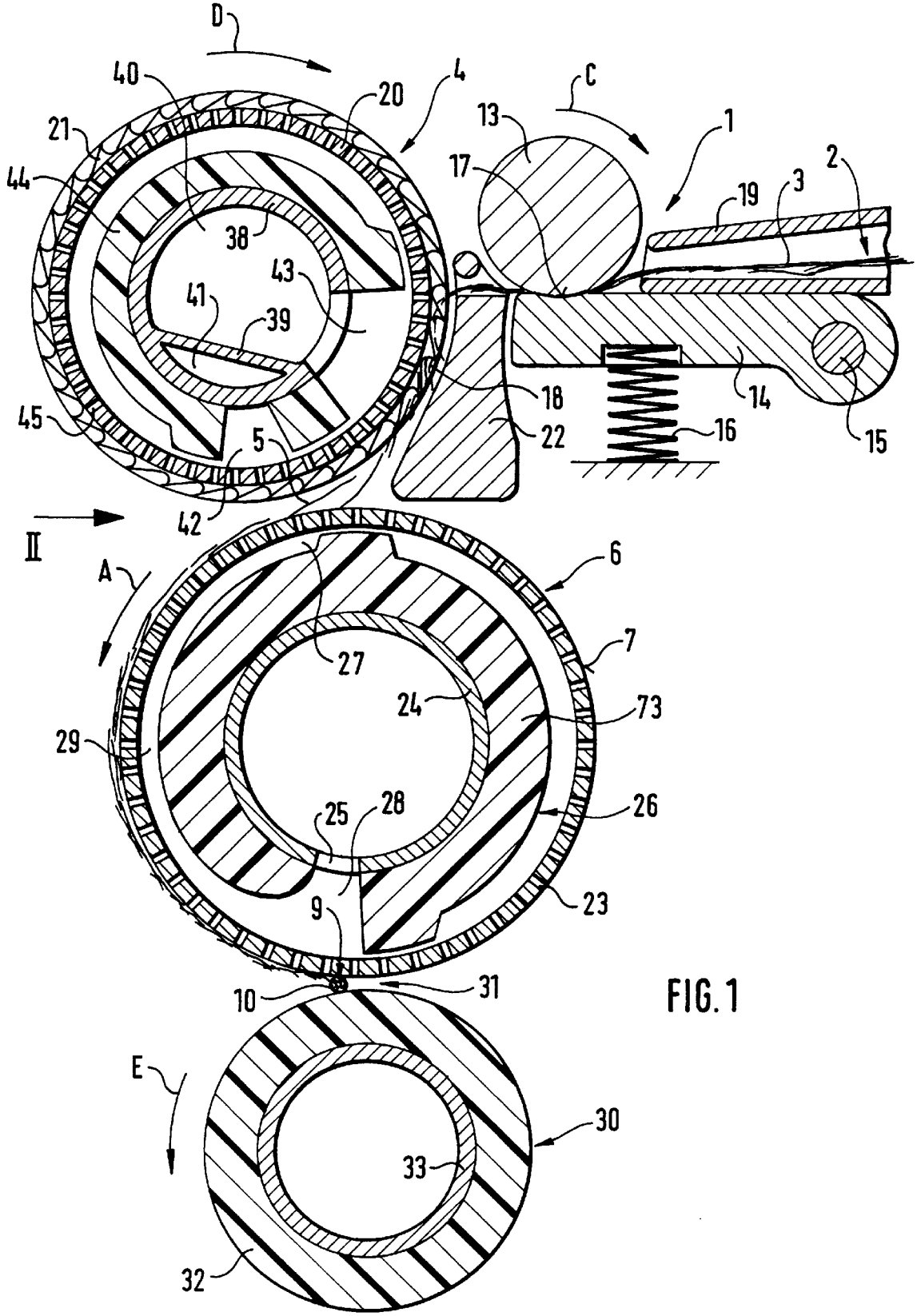
FIG. 1 is a sectional side view of an arrangement according to the present invention.
Figure 2:
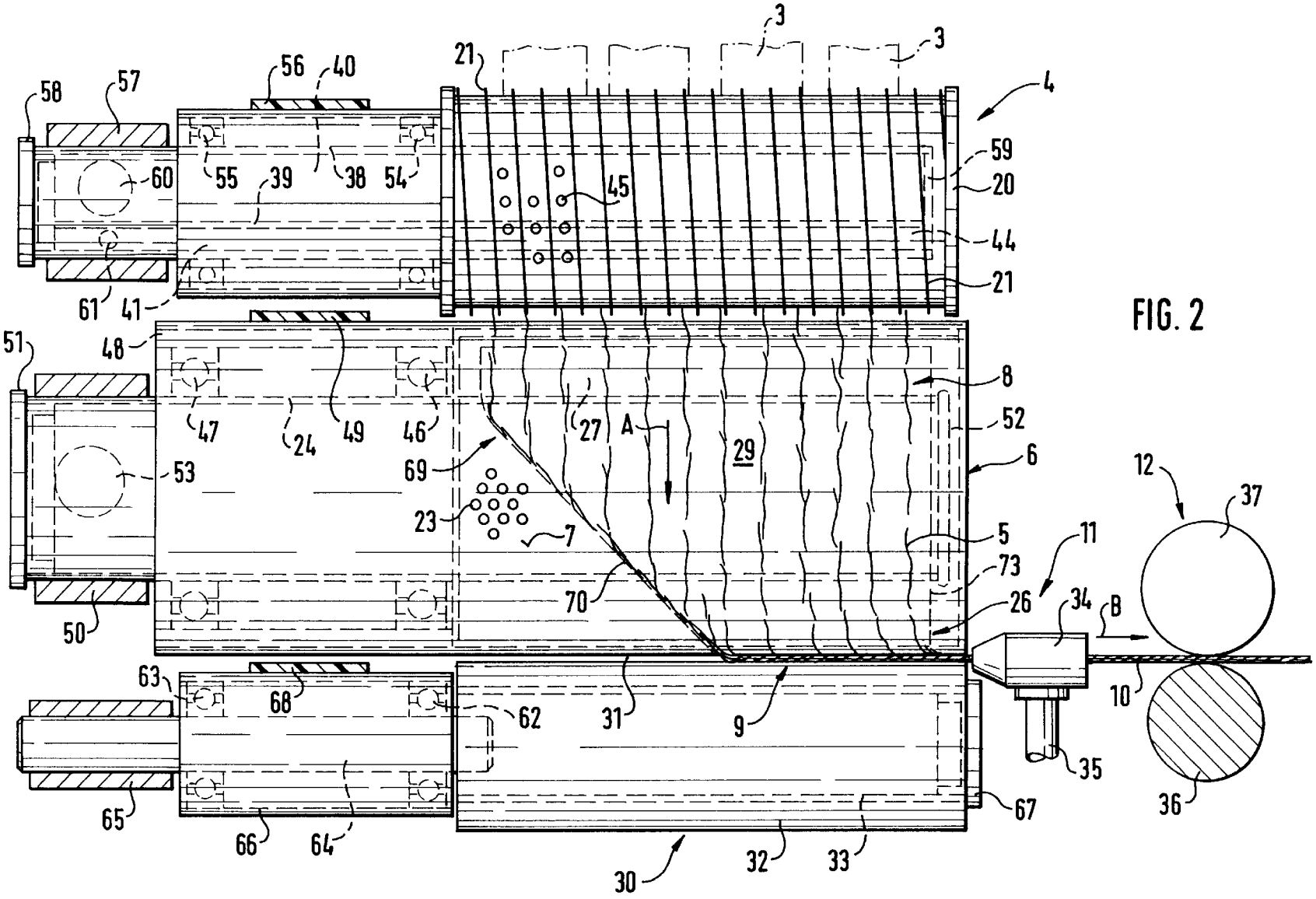
FIG. 2 is a view in the direction of the arrow II in FIG. 1.

The arrangement shown in FIGS. 1 and 2 comprises a feed device 1 for feeding fiber material 2 to be spun, which can consist of a plurality of adjacently arranged slivers 3. The arrangement comprises further an opening device 4 for opening the fed fiber material 2 into single fibers 5. A rotating suction roller 6 adjoins the opening device 4, the peripheral surface 7 of said suction roller 6 serving as a collecting surface for taking up a fibrous veil 8 formed from the single fibers 5. The suction roller 6 guides the fiber veil 8 to a yarn formation line 9 arranged transversely to the transport direction A of said suction roller 6, at which yarn formation line 9 the yarn 10 forms with a continuously renewing fiber tip. This arrangement comprises further a twist device 11 for spinning the single fibers 5 in the yarn 10, a withdrawal device 12 for withdrawing the spun yarn 10 in withdrawal direction B, and also a winding device (not shown).

The feed device 1 comprises a feed roller 13 rotating in direction C, at which at least one feed table 14, according to the structure of the slivers 3, is arranged. The feed table 14 can be swivelled around a swivel axle 15 under the action of a loading spring 16 and forms a nipping point 17 during operation together with the feed roller 13, from which the fiber material 2 forms a so-called fiber beard 18. A feed condenser 19 is arranged upstream of the feed roller 13.

The opening device 4 comprises an opening roller 20 rotating in direction D, whose circumference is fitted with opening structure 21 in a known way, with which the fiber beard 18 is opened to single fibers 5. The effective width of the opening roller 20 corresponds to the effective width of the suction roller 6 and the width of the fiber veil 8. The fiber beard 18 is pressed into the opening structure 21 from the back side by means of a stationarily arranged fiber beard support 22.

The suction roller 6 mentioned above is arranged directly adjoining the opening roller 20, the speed of the suction roller 6 being adapted to the current speed of the opened single fibers 5. Due to a perforation 23, the periphery of the suction roller 6 is air-permeable, whereby a suction insert denoted in its entirety by the reference number 26 is applied to the inside of the suction roller 6. This ensures that the fiber veil 8 is taken up when it hits the surface 7 of the suction roller 6 and is transported in transport direction A to the yarn formation line 9. The transport path should not be too small; a suction roller 6 diameter of between 80 and 120 mm is recommended.

The suction insert 26 comprises a suction tube 24, on which the suction roller 6 is supported in a way to be described below. In the area of the Yarn formation line 9, the suction tube 24 is provided with a suction opening 25. As is the case in the inside of the suction roller 6, a plastic ring 73 is adjustably supported on the suction tube 24, which ring 73 defines the area in which the single fibers 5 are held on the surface 7 of the suction roller 6, and which plastic ring 73 forms together with the suction tube 24 the suction insert 26.

The suction insert 26 defines first a take-up zone 27, which extends over the effective width of the suction roller 6 and which is applied in that area in which the fibrous veil 8 hits the surface 7 of the suction roller 6. The suction insert 26 defines further a main suction slit 28, which is located in the area of the yarn formation line 9 and extends essentially transversely to the transport direction A of the suction roller 6. The take-up zone 27 and the more strongly suctioned main suction slit 28 are connected by means of a suction area 29. This will be explained below in more detail in connection with FIG. 3.

Even when the circumferential speed of the suction roller 6 should meet the above mentioned requirements, the suction roller 6 is still in a position to impart a degree of pre-twist to the yarn 10 forming in the yarn formation line 9. The pre-twist can be increased when a supplementary roller 30 is arranged at the yarn formation line 9, which supplementary roller 30 forms, together with the suction roller 6, a wedge-shaped gap 31 in the area of the yarn formation line 9 known from friction spinning. The supplementary roller 30 is driven in the same direction as the suction roller 6, namely in direction E, and can also take the form of a suction roller. In the embodiment described here, the supplementary roller 30 is provided with a friction lining 32, which is mounted on a tube 33. If, in the formation phase of the yarn 10, a higher momentary strength is required, the supplementary roller 30 can take the form of a nipping roller and can be disposed clamped to the suction roller 6.

The main twist of the forming yarn 10 is imparted by means of a separate twist device 11, in the case of the present embodiment by means of a spinning jet 34, which is known in principle from pneumatic false twist spinning. By means of the friction roller pair formed by the suction roller 6 and the supplementary roller 30 on the one hand, and the spinning jet 34 on the other hand, the final twist of the yarn 10 is imparted in two stages. The spinning jet 34 is provided in a known way with a compressed-air supply 35.

The spinning jet 34 is arranged upstream of the withdrawal device 12, mentioned above, in withdrawal direction B of the yarn, which withdrawal device 12 comprises a driven bottom cylinder 36 and a pressure roller 37 disposed flexibly thereon. From there the yarn 10 reaches a winding device, where it is wound up onto a cross package.

The opening roller 20 is supported on a tube 38, through which suction air as well as compressed air is fed. The tube 38 is divided by a web 39 into a suction chamber 40 and a compressed air chamber 41. In the upper area in FIG. 1, namely the suction chamber 40, a vacuum prevails, and in the lower area, namely the compressed-air chamber 41, pressure prevails.

In a blast area 42 directed against the suction roller 6, blast air exits out through the combing structure 21 of the opening roller 20. This is to facilitate the transfer of the opened single fibers 5 to the suction roller 6. Where the fiber beard 18 is combed, suction air streams from outside into a suction area 43 in the inside of the opening roller 20. As can be seen, the blast area 42 and the suction area 43 are separated by an extension of a plastic ring 44. The surface of the opening roller 20 is made air-permeable by means of a perforation 45.

The suction area 43 ensures that the fiber beard 18 is drawn deeper into the combing structure 21 of the opening roller 20. The fiber beard 18 cannot therefore evade combing. This enables the speed of the opening roller 20 to be reduced considerably, so that it is possible to permit the fiber veil 8 to impact on the surface 7 of the suction roller 6 at a relatively low speed. It is made possible for the fiber material 2, starting from the slivers 3, never to be reduced in speed during the spinning process, but rather ideally to be constantly accelerated somewhat, without the withdrawal speed of the yarn 10 from the yarn formation line 9 becoming uncontrollably fast.

The compressed air in the compressed-air chamber 41 of the tube 38 flows out through the perforation 45 of the opening roller 20 and reaches the suction insert 26 by means of the perforation 23 of the suction roller 6. This ensures a reliable transfer of the single fibers 5 to the suction roller 6.

In order that the twist device 11 can be guided close to the suction roller 6, the suction roller 6 is supported by means of ball bearings 46 and 47 on the suction tube 24 and freely overhangs same. The ball bearings 46 and 47 are located on the side of the suction roller 6 facing away from the twist device 11, so that there are no bearing elements present between the suction roller 6 and the twist device 11. On the one hand this reduces the unguided section of the yarn 10 from the suction area 29, while on the other, the necessary twist is imparted to the yarn 10 at an early stage.

In the area of the ball bearings 46 and 47 the suction roller 6 comprises a bearing outer ring 48 in its interior. The surface 7 of the suction roller 6 serves in this area as a supporting surface for a drive belt 49. On the side facing away from the suction insert 26, the suction tube 24 is securely clamped in a holding device 50 and closed by means of a plug 51. The other end of the suction tube 24 is covered by the front surface 52 of a plastic ring 73. The suction tube 24 is provided in the area of the holding device 50 with a vacuum connection 53.

In order that the arrangement of the twist device 11, preferably a spinning jet 34, is not hindered, the opening roller 20 is also supported on the above mentioned tube 38 by means of ball bearings 54 and 55 on the side facing away from the twist device 11. In this area, a drive belt 56 is disposed from the outside on a corresponding extension of the opening roller 20. On the side facing away from the combing structure 21, the tube 38 is clamped into a holding device 57 and closed there by means of a plug 58. The tube 38 has a bottom 59 at its other end. In the area of the holding device 57, the tube 38 is provided with an vacuum connection 60 as well as with a compressed air supply 61.

The supplementary roller 30 is also supported freely overhanging by means of ball bearings 62 and 63 on the side facing away from the twist device 11. For this purpose, a stationary axle 64 is clamped in a holding device 65 on the side facing away from the supplementary roller 30. The tube 33 of the supplementary roller 30 is expanded by means of a hub 66 into a bearing housing, on which a drive belt 68 is disposed from the outside. The tube 33 is closed by means of a plug 67 in the area of the twist device 11.

The free overhanging support of the suction roller 6, the supplementary roller 30 and the opening roller 20 permits the twist device 11 to be applied to that place at the yarn formation line 9 where fiber collection ends. Directly upstream of the twist device 11, the last single fibers 5 reach the almost completed yarn 10, around which they are wound. As soon as the last of the single fibers 5 arrives, the yarn 10 enters the twist device 11, preferably a spinning jet 34. The twist device 11 thus adjoins the collecting area almost without a space therebetween.

As can be seen from FIG. 2, the yarn formation line 9 is bent on the side facing away from the twist device 11 in the direction towards the take-up zone 27. A bent yarn tip 69 thus arises, whose direction is determined by a guiding edge 70 of the suction area 29 of the suction insert 26. As a result of the bending, there is a small but definite thrust component in transport direction A in the area of the yarn tip 69. The outermost end of the yarn tip 69 is hereby twisted somewhat as well as receiving a slight thrust. The suction roller 6 therefore aids in regularly withdrawing the yarn tip 69, so that hanging or thin spots are avoided.

Figure 3:
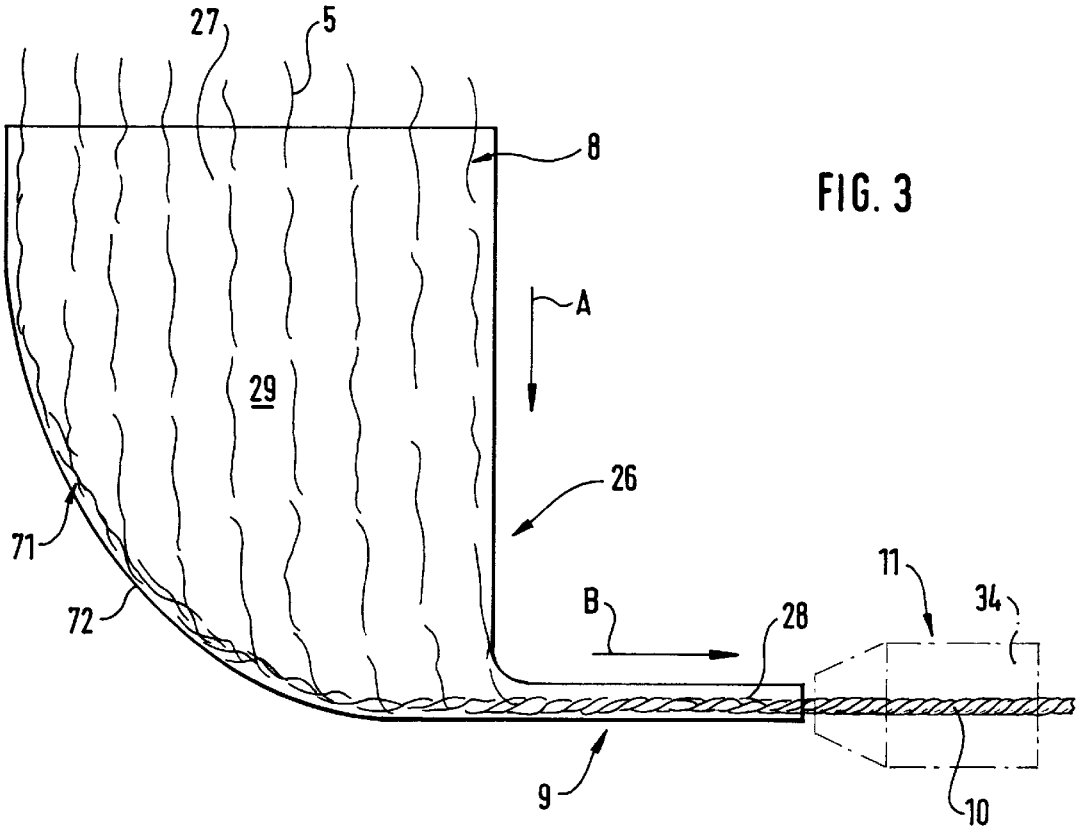
FIG. 3 is a schematic representation of the suction area of the suction roller and the formation phase of the yarn, according to preferred embodiments of the present invention.

The suction area 29 of the suction insert 26 is shown separately in FIG. 3, whereby, however, an evenly curved yarn tip 71 is provided along a guiding edge 72. The curve extends from the yarn formation line 9 to the area of the take-up zone 27.

The area of the yarn tip 71 facing the take-up zone 27 is almost in a radial plane, in relation to the surface 7 of the suction roller 6, while the yarn 10 is withdrawn practically parallel to the axis, in relation to the suction roller 6. The yarn tip 71 receives in the area of its formation a thrust in transport direction, while the finished yarn 10 receives none.

The outermost end of the yarn tip 71 comprises only a few single fibers 5. If these did not arrive absolutely regularly, the risk would exist, in the case of a non-bent yarn tip 71, that the outermost tip would hang, that is, it would not be completely withdrawn in a sufficiently reliable enough way. These "hangers" usually appear in the finished yarn 10 as thin spots. The degree of the bend or curve which is most favorable for spinning must be first tried and tested, depending on which fiber material 2 is used.

The above mentioned guiding edges 70 in FIG. 2, or 72 in FIG. 3, are inclined in relation to the yarn formation line 9 in withdrawal direction B and graduate in a slight curve into the yarn formation line 9.

The fiber veil 8, initially closed, is taken up in the above mentioned take-up zone 27 by the suction roller 6, that is, in a first section of the transport path. The nearer the fiber veil 8 comes to the yarn formation line 9, the more it is disposed on the guiding edge 70 bzw. 72. As a result of the inclination, a degree of twist arises already in the bent yarn tip 69 or 71, the extent of the twist being determined by the size of the angle of inclination of the guiding edge 70 or 72. The amount of thrust in the transport direction and the degree of twist are determined by the angle of inclination.

The starting point for the spinning process is a very wide fiber beard 18, to which a correspondingly wide fiber veil 8 corresponds. The speed of the fiber veil 8 should not be higher than the withdrawal speed of the yarn 10 along the yarn formation line 9. The necessary twist can be applied more easily in the forming yarn 10 when the withdrawal speed is not excessively high. For this reason, the fiber veil 8 should be transported to the surface 7 of the suction roller 6 at a lowest possible speed. It is therefore provided that the suction roller 6 takes up the single fibers 5 directly after the fiber beard 18 has been opened.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning assembly comprising:

an opening device operable to open a fiber sliver beard into separate fibers, a rotatably driven suction roller disposed to take up individual fibers directly after the fiber beard has been opened and operable to transport the fibers from the opening device to a suctioned yarn formation line of the suction roller formed by a suction slot extending in an axial direction up to adjacent an end of the suction roller, and a twist device operable to apply twist to yarn supplied from the suctioned yarn formation line, wherein the suction roller is rotatably supported at bearings spaced from a suction roller end which faces the twist device and with no suction roller bearing elements between the twist device and the suction roller, to accommodate positioning of an exit end of the suctioned yarn formation line immediately adjacent the twist device thereby minimizing hanging down of the newly forming yarn tip between the suctioned yarn formation line and the twist device.

2. An arrangement according to claim 1, wherein the yarn formation line is bent in a direction toward the twist device on a side of the suction roller facing away from the twist device.

3. An arrangement according to claim 2, wherein the yarn formation line reaches to the area of the take-up zone and extends there at least approximately in a transport direction of the suction roller.

4. An open-end spinning assembly according to claim 1, wherein the suction roller is rotatably supported on the bearings at a suction insert of the suction roller.

5. An arrangement according to claim 4, wherein the yarn formation line is bent in a direction toward the twist device on a side of the suction roller facing away from the twist device.

6. An arrangement according to claim 3, wherein the yarn formation line reaches to the area of the take-up zone and extends there at least approximately in a transport direction of the suction roller.

7. An arrangement according to claim 1, wherein the suction effect of the suction insert is greater in the area of the yarn formation line than in the remaining areas.

8. An open-end spinning assembly according to claim 4, wherein a supplementary roller is arranged at the suction roller and driven in the same direction, said supplementary roller together with the suction roller forming a wedge-shaped gap at least in the area of the yarn formation line facing the twist device.

9. An open-end spinning assembly according to claim 8, wherein the supplementary roller is rotatably supported at bearings spaced from an end which faces the twist device.

10. An open-end spinning assembly according to claim 9, wherein the suction effect of the suction insert is greater in the area of the yarn formation line than in the remaining areas.

11. An open-end spinning assembly according to claim 8, wherein the supplementary roller takes the form of a nipping roller.

12. An open-end spinning assembly according to claim 11, wherein the suction effect of the suction insert is greater in the area of the yarn formation line than in the remaining areas.

13. An open-end spinning assembly according to claim 4, wherein the suction effect of the suction insert is greater in the area of the yarn formation line than in the remaining areas.

14. An open-end spinning assembly according to claim 1, wherein the twist device is an air spinning jet device.

15. An open-end spinning assembly according to claim 14, wherein a supplementary roller is arranged at the suction roller and driven in the same direction, said supplementary roller together with the suction roller forming a wedge-shaped gap at least in the area of the yarn formation line facing the twist device.

16. An open-end spinning assembly according to claim 15, wherein the supplementary roller is rotatably supported at bearings spaced from an end which faces the twist device.

17. An open-end spinning assembly according to claim 15, wherein the supplementary roller takes the form of a nipping roller.

18. An open-end spinning assembly according to claim 1, wherein a supplementary roller is arranged at the suction roller and driven in the same direction, said supplementary roller together with the suction roller forming a wedge-shaped gap at least in the area of the yarn formation line facing the twist device.

19. An arrangement according to claim 18 wherein the supplementary roller takes the form of a nipping roller.

20. An open-end spinning assembly according to claim 18, wherein the supplementary roller is rotatably supported at bearings spaced from an end which faces the twist device.

21. An open-end spinning assembly according to claim 20, wherein the opening device is an opening roller rotatably supported at bearings spaced from an end of the opening roller which faces the twist device.

22. An open end spinning assembly according to claim 18, wherein the opening device is an opening roller rotatably supported at bearings spaced from an end of the opening roller which faces the twist device.

23. An open-end spinning assembly according to claim 22, wherein the supplementary roller takes the form of a nipping roller.

24. An open-end spinning assembly according to claim 1, wherein the opening device is an opening roller rotatably supported at bearings spaced from an end of the opening roller which faces the twist device.

* * * * *